US005659971A

United States Patent [19]

Haleen

[11] Patent Number: 5,659,971

[45] **Date of Patent: *Aug. 26, 1997**

[54] AGGRESSIVE CONVECTIVE DRYING IN AN NUTSCHE TYPE FILTER/DRYER

[75] Inventor: Len W. Haleen, Edwardsville, Ill.

[73] Assignee: Mallinckrodt Medical, Inc., St. Louis, Mo.

[ * ] Notice: The term of this patent shall not extend beyond the expiration date of Pat. No. 5,544,424.

[21] Appl. No.: 643,221

[22] Filed: May 3, 1996

Related U.S. Application Data

[62] Division of Ser. No. 443,250, May 17, 1995, Pat. No. 5,554,425.

[51] Int. Cl.[6] ..... F26B 17/12

[52] U.S. Cl. ..... 34/166; 34/179

[58] Field of Search ..... 34/397, 407, 425, 34/426, 82, 166, 179, 187

[56] References Cited

U.S. PATENT DOCUMENTS

| | | | |
|---|---|---|---|
| 5,105,557 | 4/1992 | Vadasz et al. | 34/426 X |
| 5,333,396 | 8/1994 | Kanai | 34/166 |
| 5,544,425 | 8/1996 | Haleen | 34/187 |
| 5,546,767 | 8/1996 | Haleen | 34/187 |
| 5,554,424 | 9/1996 | Haleen | 34/181 |

*Primary Examiner*—John M. Sollecito
*Assistant Examiner*—Steve Gravini
*Attorney, Agent, or Firm*—Brian K. Stierwalt

[57] ABSTRACT

The present invention relates to improved drying techniques which increase the capacity and efficiency of agitated pan type dryers. In particular, the present invention relates to a nutsche type filter/dryer apparatus and method for aggressive convective drying of hard to dry chemical compounds, such as pharmaceuticals. The aggressive drying is brought about by creating turbulence within the drying vessel during the drying cycle. Significant reductions in drying cycle times have been achieved.

15 Claims, 3 Drawing Sheets

AGGRESSIVE CONVECTIVE DRYING IN AN NUTSCHE TYPE FILTER/DRYER

This is a divisional of application Ser. No. 08/443,250 filed on May 17, 1995, now U.S. Pat. No. 5,544,425.

The present invention relates to improved drying techniques for materials which are difficult to dry. In particular, the present invention relates to improved drying techniques which extend the use of agitated pan dryers or the like to drying of difficult to dry chemical materials.

In the production of numerous chemical products, including pharmaceuticals, it may be necessary to dry intermediates and/or the final product. This is usually accomplished by means of a drying apparatus, of which there are many different types, and which may be classified according to the drying operation. For example, Perry's Chemical Engineers Handbook (5th Edition) separates dryers into three categories; direct dryers, infrared or radiant-heat dryers, and indirect dryers.

Agitated pan dryers are generally included in the classification of indirect batch dryers wherein the heat for drying is transferred to the wet solid through a retaining wall. Liquid which is vaporized from the wet solid is removed by means separate from the heating means. In general, the rate of drying depends on the contact between the wet solid and the hot surfaces of the dryer.

Standard agitated pan dryers as shown in schematic cross-section in FIG. 1, consist of a relatively shallow flat-bottomed pan 10, covered by a dished or conical cover 20. The bottom and walls of the pan 10, are surrounded by a jacket 30, to contain the heating medium, such as steam. However, it is noted that not all agitated pan dryers include a jacket for the heating medium. A central vertical shaft 40, attached to a drive means 42, carries a slow-moving, heavy-duty agitator 45, which stirs the material in the dryer and moves the material toward and away from the heat-transfer surfaces. The agitator shaft 40, may enter either through the cover 20, or through the bottom 15, of the pan 10, and may include additional means to scrape the heat-transfer surface or to better agitate the material during drying. Heating medium may also be circulated within the agitator to add extra heating surfaces, or the only heating surfaces when no jacket is provided. The blades of the agitator may be capable of being raised and lowered to accommodate different loads within the dryer, and to adjust to the changing level of the product during drying. Agitated pan dryers may be operated either under atmospheric pressure or under vacuum. In both cases, the cover is normally provided with an outlet 50, for the release of vaporized liquids, the outlet 50, being attached to a vacuum connection if desired. A charge/discharge port 60, for charging wet material and removing dried material is normally provided through the side of the pan 10, but may also be provided through the bottom 15, of the pan 10. In the alternative, no charge/discharge port may be included and material may simply be charged and withdrawn by opening the cover 20.

Agitated pan dryers are most useful for drying batches of material which must be agitated during drying, e.g. materials which are hard to handle or for which continuous drying would be uneconomical. Agitated pan dryers are particularly useful when solvents are to be recovered upon vaporization from the wet solid; or when drying must be done under high vacuum. However, agitated pan dryers are not generally suitable for materials which suffer particle degradation during drying or which form into balls and caseharden during drying.

Many chemical products, especially pharmaceutical products, are organic in nature and may decompose if exposed to excessive temperatures. Further, such products may not be crystalline in nature, may have very small particle sizes, and may require removal of toxic, and/or flammable solvents. Volatile content following drying is often required to be very low, e.g. less than one percent. Such products may be very difficult to dry. In particular, the material often becomes sticky during drying and may form into balls which can easily caseharden. When this occurs, the required low volatile content can not be met. Therefore, long drying cycles are often necessary to obtain satisfactory results.

Direct drying wherein there is a direct contact between the wet solid and drying medium, such as hot gases, is also known. In such dryers the vaporized liquid from the wet solid is normally carried away by the drying medium. Direct dryers are often referred to as convective dryers. Most standard convective dryers can not be easily operated under vacuum and therefore may not be applicable to the drying of chemical or pharmaceutical products in which toxic solvents must be removed.

To increase drying efficiency, direct drying means have previously been added to indirect dryers. In particular, agitated pay dryers may be converted to include means for blowing drying medium over the surface of the wet solid in addition to the standard indirect heating though the walls and bottom of the pan. This technique helps to extend the range of types of materials that can be dried efficiently in agitated pan type dryers. One such combination is described below.

FIG. 2 is a cross-sectional view of a nutsche type filter/dryer, generally designated by reference numeral 100, as known in the prior art. In particular the nutsche filter/dryer 100, is a standard nutsche type filter which has been modified for use as a dryer and is essentially a variant of an agitated pan dryer. The similarities will be evident from the following description. In particular, the nutsche filter/dryer 100, includes a compression vessel 120; a gas inlet 130; and a gas outlet 140, having a dust collector 145, connected thereto. The nutsche filter/dryer 100, also includes a drive means 150, connected to a main shaft 154, having two sets of extending arms mounted at 90° to each other. A first set of arms comprise flat blades (not shown) which act to smooth product 190, introduced to the vessel 120, in batches suitable for drying. A second set of arms 156, include multiple agitator extensions 158. The filter/dryer 100, further includes an inner discharge tube 160, situated within an outer discharge shaft 170, and a filter plate 180, located at the base of the vessel 120.

The main shaft 154, may be designed to both rotate and move vertically within the vessel 120. The first set of arms are fixed to and carried by the main shaft 154, while the agitator arms 156, can be moved vertically and independently of the main shaft 154. The inner discharge tube 160, is designed to move vertically within the fixed outer discharge shaft 170.

In use, the inner discharge tube 160, and main shaft 154, are raised to their highest vertical position. This in turn raises both sets of arms to their highest position. A feed slurry of product 190, to be dried is fed into the space bounded by the filter plate 180, the walls of the vessel 120, and the discharge tube 160. Because the filter plate 180, occupies the space which would normally be occupied by the heated plate of an agitated pan dryer, heating medium is circulated through the two sets of arms (i.e. the flat blades and the agitator arms 156). In this manner heat is transferred to the product 190, to evaporate solvent therefrom. Roughly sixty percent of the heat transfer is accomplished through the agitator arms 156, and flat blades, with the remainder being accomplished by contact between the heated walls of the vessel 120, and the product 190.

In order to increase drying times land efficiency, recirculated nitrogen gas may be fed into the vessel 120, to cause some direct or convective drying to occur. Attempts to circulate the nitrogen gas either up through the filter plate 180 or down through the product 190, may be largely frustrated and ineffective when the product 190, is difficult to dry for those reasons given above; e.g. small particle size, sticky, likely to caseharden, etc. This is because such product 190 either plugs the filter plate 180, or effectively seals off the nitrogen gas flow. Therefore, the nitrogen gas may be simply fed through the inlet tube 130, to pass over the surface of the product 190, as illustrated by the arrows within the vessel 120. The drying gas exits through the gas outlet 140, and the dust collector 145, and then is recirculated for further use. As the drying gas passes over the product 190, limited convective drying occurs and volatiles within the product 190, are evaporated. This is known as cross flow drying.

Perlmutter describes a classic drying curve, as shown in FIG. 3, wherein a constant drying rate takes place during a first phase. According to Perlmutter, the constant rate period is governed by external factors such as the gas mass velocity and thermodynamic state as well as the physical state of the product. Perlmutter particularly notes that when drying products having a tendency to form balls in the constant rate drying phase, convection drying should be carried out on a static (non-agitated) bed and should so continue until the critical moisture content is reached. Perlmutter further suggests that during the falling rate period, cake properties and heat input are the controlling factors. Finally, in the diffusion period, the agitator arms break up product clumps to provide a final product which is homogenous and fine powder. (See Perlmutter; Principles Of Pressure Nutsche Filter-Dryer Technology; Drying '92; edited by A. S. Mujumdar; pp 1321–1329; Elsevier Science Publishers, B.V.; 1992).

However, as will be explained below, drying in real world applications has proven to be more complicated than suggested by the classical theory. For example, using the same gas mass flow rates, two dryers may exhibit dramatically different drying performances. Moreover, it has been, found that even doubling the flow rate of nitrogen gas provides only marginal improvement and actually significantly worsens thermal efficiency, in spite of the opposite conclusions which would be drawn from the classical theory.

Therefore, there remains a need in the art for improvements to convection drying of chemical compounds in agitated pan type dryers.

OBJECTS OF THE INVENTION

It is one object of the present invention to provide improvements to convection drying of chemical compounds in agitated pan type dryers.

It is a further object of the present invention to provide increased throughput of material through an agitated pan type dryer by increasing thermal efficiency and drying rate, thus reducing the time required for drying, without sacrificing volatile removal efficiency or yield.

SUMMARY OF THE INVENTION

The objects of above and others are accomplished according to the present invention by creating turbulence within the dryer, particularly at the surface of the product. This is accomplished by forcing pressurized drying gas into the dryer at high velocity through a nozzle. The use of a nozzle acts to convert hydrostatic energy (pressure) of the drying gas into hydrokinetic energy (flow velocity) which is necessary to create turbulence within the dryer.

DETAILED DESCRIPTION OF THE INVENTION

Figure 1:
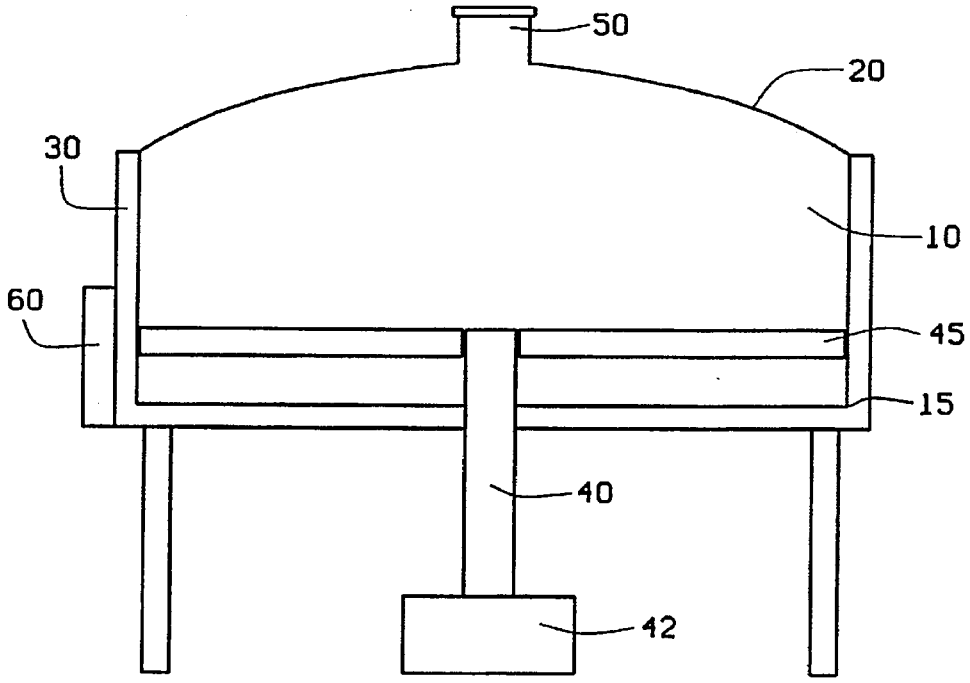
FIG. 1 PRIOR ART
FIG. 1 is a cross-sectional view of an agitated pan dryer as known in the prior art.
Figure 2:
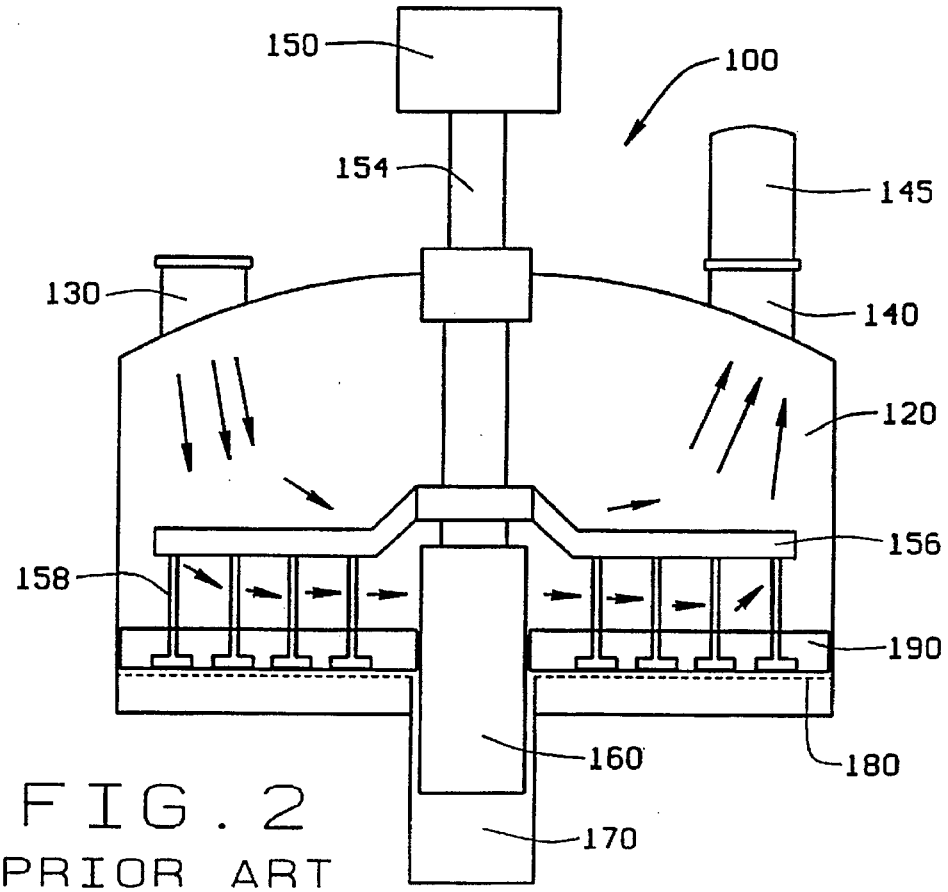
FIG. 2 PRIOR ART
FIG. 2 is a cross-sectional view of a nutsche type filter/dryer equipped for convection drying as known in the prior art.
Figure 3:
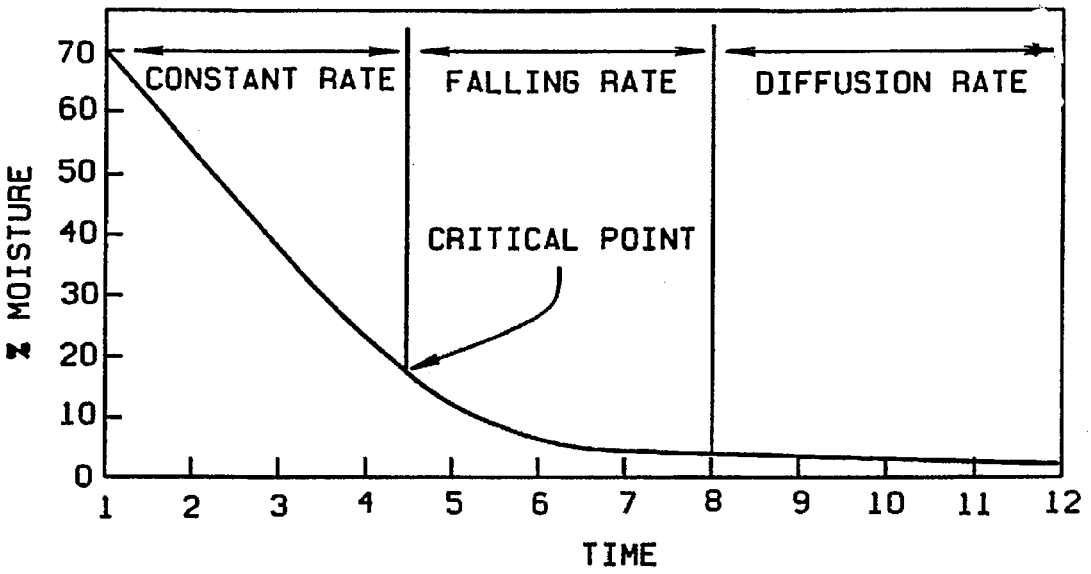
FIG. 3 PRIOR ART
FIG. 3 is a chart describing classical drying theory as known in the prior art.

A nutsche type filter/dryer equipped for convection drying is described above with reference to FIG. 2. The improvements according to the present invention will be discussed below with respect to FIGS. 4 and 5, wherein like parts are identified by like reference numerals as were used in FIG. 2.

Figure 4:
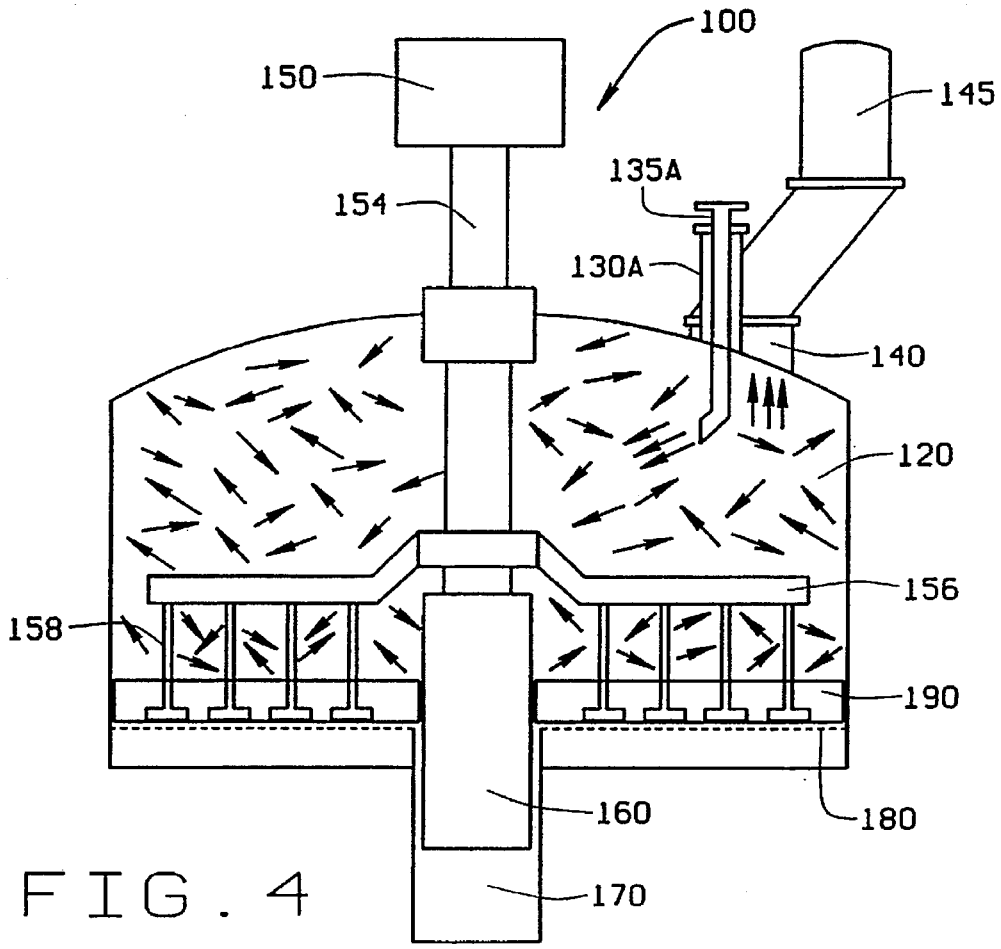
FIG. 4 is a cross-sectional view of a nutsche type filter/dryer as shown in FIG. 2, further showing an improvement according to one embodiment of the present invention.

FIG. 4 is a cross-sectional view of a nutsche type filter/dryer, generally designated by reference numeral 100, and showing an improvement according to one embodiment of the present invention. The dryer 100, includes the pressure vessel 120, gas outlet 140, dust collector 145, and agitator system as describe above with reference to FIG. 2.

The improvement according to the present invention comprises a newly designed drying gas inlet including a high velocity nozzle 135A, fixed within an outer gas inlet shaft 130A. In the embodiment shown in FIG. 4, the nozzle 135A, and inlet shaft 130A, are provided within a portion of the gas outlet 140. However, the present invention also relates to the placement of a high velocity nozzle at any position within the vessel 120.

Figure 5:
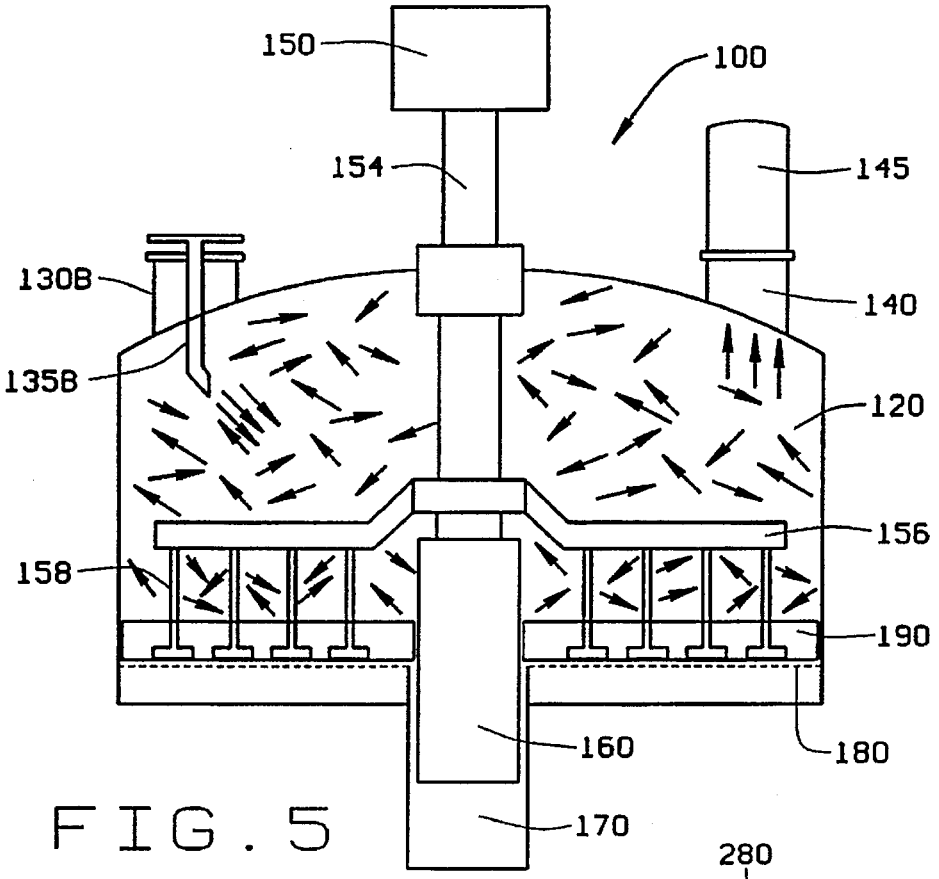
FIG. 5 is a cross-sectional view of a nutsche type filter/dryer as shown in FIG. 2, further showing an improvement according to a further embodiment of the present invention.

FIG. 5 is a cross-sectional view of a nutsche type filter/dryer, generally designated by reference numeral 100, and showing an improvement according to a further embodiment of the present invention. In particular, FIG. 5 shows the improvement of the present invention wherein the high velocity nozzle 135B, and inlet shaft 130B, are provided away from the gas outlet 140.

The drying process is the same as that described above, except that the drying gas is introduced under high pressure and at a high velocity through the nozzle 135A or 135B. This introduction creates turbulence within the vessel 120, as represented by the arrows within the vessel 120, in both FIGS. 4 and 5. The use of the high velocity nozzle 135A, or 135B converts the hydrostatic energy (pressure) of the drying gas in to hydrokinetic energy (flow velocity) which is necessary to create the turbulence with in the vessel 120. By creating turbulent flow within the vessel 120, the recirculating drying gas becomes saturated with the volatiles within the product 190, at a faster and higher rate and therefore shorter drying times are achieved.

Figure 6:
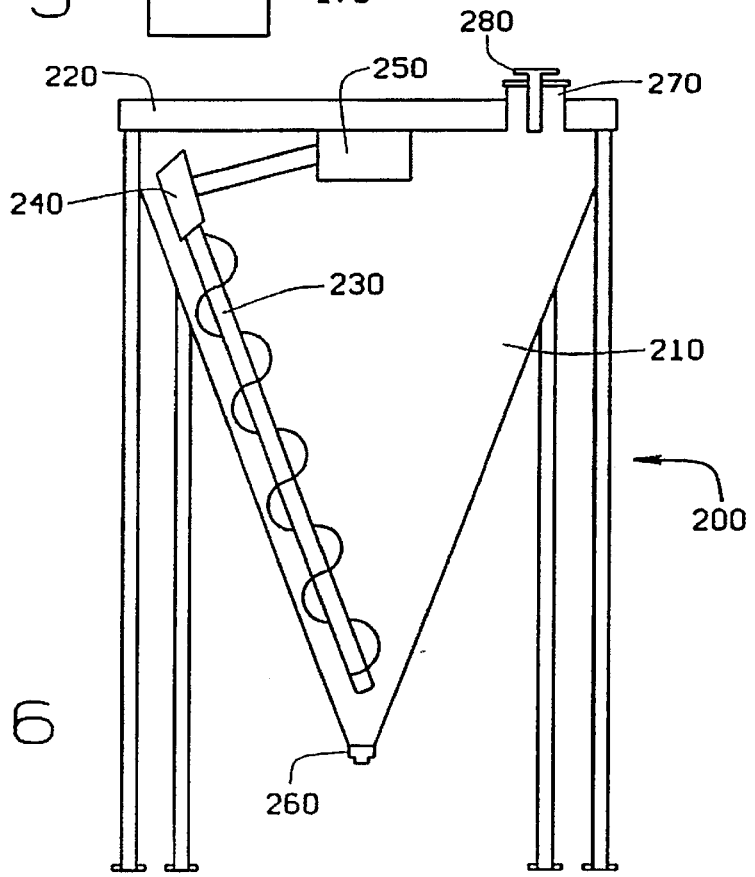
FIG. 6 is a cross-sectional view of a conical screw type mixer/dryer, further showing an improvement according to the present invention.

A further embodiment according to the present invention relates to conical screw mixers, such as shown in FIG. 6. In particular, FIG. 6, shows a conical screw mixer, generally designated by reference numeral 200, comprising a cone-shaped vessel 210, having a cover 220, through which product may be charged. A screw with a helical blade 230, is housed within the vessel 210, and is connected to a rotating drive means 240. The rotating drive means 240, is further connected to an orbiting drive means 250. In operation, the screw 230, is driven by the rotating drive means 240, which acts to mix and carry product within the vessel 210, in an upward direction. Simultaneously, the orbiting drive means 250, drives the screw 230, around a center line of the vessel 210, for top-to-bottom circulation and mixing. Reversing the rotating drive means 240, aids in discharge of product through an outlet 260. In another embodiment the screw 230, may be moved through an epicyclic action to provide more thorough coverage and mixing of the entire volume of the vessel 210.

The result of the various movements of the screw 230, is to emulate the action of an agitated pan dryer as described above. Converting the conical screw mixer to a dryer can be easily accomplished by jacketing the vessel 210, or by including means to provide drying gas, such as through an inlet port 270, to the interior of the vessel 210. The present invention of creating turbulent flow is equally applicable to the use of a conical screw mixer/dryer. In particular, as shown in FIG. 6, a high velocity nozzle 280, is provided within the inlet/outlet port 270, through the cover 220. It will be recognized that a high velocity nozzle could also be provided through the cover 220, outside the area of the port 270, or through the wall of the vessel 210.

The present invention expands the usefulness of agitated pan type dryers (including converted nutsche filters and converted conical screw mixers) into areas which would not normally have been considered. In particular, by using the present invention, agitated pan type dryers can be efficiently used for the drying of hard to dry chemical compounds, such as pharmaceuticals. This includes organic pharmaceuticals, which are typically temperature sensitive, sticky, have small particle sizes, use solvents other than water, are not crystalline, and may form casehardened balls during the drying cycle. The present invention is makes it possible to reduce the volatile level in the wet product to the required range (e.g. less than one percent) within drying times which are considerably less than achievable when using standard agitated pan dryers.

For example, during the process of making Ioversol (an X-ray contrast agent) drying of an intermediate chemical compound is necessary. This intermediate decomposes if exposed to temperatures above 90° C. In addition, this intermediate is not crystalline, has a very small particle size, and tends to form balls which case harden making volatile removal to the necessary level very difficult. Moreover, the solvent being removed is toxic, flammable and possesses a high boiling point. All of these characteristics make drying of this intermediate extremely difficult. It should be noted that these characteristics are relatively common in pharmaceutical production.

Prior art dryers were simply not up to the task of drying such an intermediate in short time frames. Therefore, greater than twenty hour drying cycles were tolerated in the nutsche filter/dryer adapted for convective drying as described in FIG. 2 above.

However, by creating turbulence within the vessel of the dryer according to the present invention, drying cycles of less than ten hours have been achieved. This shortened drying time can add as much as 30 metric tons of annual drying capacity to the use of a nutsche filter/dryer having a 3000 lb capacity, adapted as described above with reference to FIGS. 4 and 5. This in turn can greatly reduce the costs involved with the production of chemical compounds, such as pharmaceuticals. One particular savings relates to the possible elimination of the need for multiple nutsche dryers, which can cost more than four million dollars to purchase and install.

A typical process of using the dryer according to the present invention, involves the following steps. Product is loaded within the vessel of the dryer. The flow of drying gas introduced at high velocity is then initiated. The product is continuously plowed by the agitator arms in order to expose new surface areas. Gas flow is continued until the target volatile content of the product is reached. Product is then removed from the dryer vessel.

The present invention according to the present invention has been described with reference to a high velocity nozzle for creating turbulence within the dryer. However, the present invention is equally applicable to any other means or methods of creating turbulence. Moreover, the process of drying according to the present invention has been primarily described as a single stage drying operation wherein drying gas flow velocity is constant throughout the drying cycle. However, the present invention is also applicable to multiple staged drying cycles. For example, dusty products may be dried using two stages of different flow velocities, the first stage being at a relatively high velocity during the time when the product is in a relatively wet state, and the second being at a lower velocity when the product has dried to the point that dust is becoming prevalent.

The present invention is described above as relating to apparatus and methods for drying solvent laden chemical compounds, such as pharmaceuticals. However, the present invention could also be used to dry aqueous cakes of material. Moreover, while nitrogen gas is the preferred heating gas, the present invention is equally applicable to the use of other gasses, and to the use of air instead of nitrogen gas.

The present invention is described above primarily for direct or convective drying using recirculated nitrogen gas. In practice the nitrogen gas has normally been recirculated under pressure. However, the present invention is equally applicable to procedures which do not recirculate the drying gas. In addition, the present invention provides advantages for procedures operated at atmospheric as well as subatmospheric pressure.

The present invention has been described above with reference to FIGS. 4 and 5 as including a single high velocity nozzle. However, the present invention also applies to the use of two or more high velocity nozzles to create optimum turbulence conditions within the dryer. The nozzles may be operated at the same or different flow velocities to create or change particular turbulence conditions.

The foregoing has been a description of certain preferred embodiments of the present invention, but is not intended to limit the invention in any way. Rather, many modifications, variations and changes in details may be made within the scope of the present invention.

What is claimed is:

1. In a nutsche type filter modified for use as a dryer comprising:

a compression vessel having walls and a bottom;

a filter plate located on said bottom of said vessel a cover attached to and covering said vessel, said cover including an inlet port for the introduction of drying medium to said vessel and an outlet port for the release of vaporized liquids from a product charged to said vessel;

an agitator housed within said vessel, said agitator including blades for smoothing and plowing product charged to said vessel; and a drive means attached to said agitator and adapted to drive said agitator;

the improvement comprising:

means to create turbulence within said vessel during a drying cycle.

2. A nutsche filter according to claim 1, wherein means to create turbulence comprises at least one high velocity nozzle for injecting drying medium at high velocity into said vessel.

3. A nutsche filter according to claim 2, wherein one high velocity nozzle is provided and is located within said inlet port.

4. A nutsche filter according to claim 2, wherein said inlet port is located within a portion of said outlet port and wherein one high velocity nozzle is provided and is located within said inlet port.

5. A nutsche filter according to claim 1, wherein said dryer further includes a jacket surrounding said walls of said vessel, said jacket providing an area for the circulation of heating medium.

6. A nutsche filter according to claim 1, wherein said blades of said agitator are adapted to allow heating medium to be circulated therein.

7. A nutsche filter according to claim 1, wherein said agitator is provided through said cover.

8. A nutsche filter according to claim 1, wherein said agitator is provided through said bottom of said vessel.

9. A nutsche filter according to claim 1, wherein said blades of said agitator are adapted to be raised and lowered to adjust to the level of product charged to said vessel.

10. A nutsche filter according to claim 1, wherein said blades of said agitator include agitator extensions which extend from a lower side of said blades toward said bottom of said vessel, said agitator extensions being adapted to mix product charged to said vessel.

11. A nutsche filter according to claim 1, wherein said outlet port is connected to a source of vacuum.

12. A nutsche filter according to claim 1, wherein said dryer further includes a dust collector connected to said outlet port.

13. A nutsche filter according to claim 1, wherein said dryer further includes a charge/discharge port for charging product to and withdrawing product from said vessel.

14. A nutsche filter according to claim 13, wherein said charge/discharge port is provided through one said wall of said vessel.

15. A nutsche filter according to claim 13, wherein said charge/discharge port is provided through said bottom of said vessel.

* * * * *